US005495845A

United States Patent [19]

Hait

[11] Patent Number: 5,495,845

[45] Date of Patent: Mar. 5, 1996

[54] COMPACT OUTDOOR COOKING UNIT

[75] Inventor: Paul W. Hait, Sunriver, Oreg.

[73] Assignee: Pyromid, Inc., Redmond, Oreg.

[21] Appl. No.: 361,144

[22] Filed: Dec. 21, 1994

[51] Int. Cl.[6] ..... F24C 1/16

[52] U.S. Cl. ..... 126/9 R; 126/9 A; 126/29; 126/25 R; 99/339

[58] Field of Search ..... 126/9 R, 9 A, 126/29, 25 R; 99/339

[56] References Cited

U.S. PATENT DOCUMENTS

| | | | |
|---|---|---|---|
| 1,587,157 | 10/1924 | Hull . | |
| 2,645,993 | 7/1953 | Voss | 9/129 |
| 3,103,160 | 9/1963 | Forniti et al. | 99/339 |
| 3,384,066 | 5/1968 | Tufts | 126/9 |
| 3,494,349 | 2/1970 | Allen | 126/25 R |
| 3,682,154 | 8/1972 | Mollere | 126/9 A |
| 4,149,514 | 4/1979 | Latouf | 126/9 R |
| 4,489,706 | 12/1984 | Hait | 126/9 R |
| 4,508,094 | 4/1984 | Hait . | |
| 4,531,505 | 7/1985 | Hait et al. | 126/9 R |
| 4,545,359 | 10/1985 | Hait | 126/9 R X |
| 4,829,975 | 5/1989 | Hait | 126/9 R |
| 4,877,010 | 10/1989 | Hait | 126/9 A |
| 5,195,550 | 3/1993 | Lerner | 126/29 |

OTHER PUBLICATIONS

Publication by Pyromid, Inc., titled Pyromid's Eagle Outdoor Cooking System, published during the year 1991.

*Primary Examiner*—Larry Jones
*Attorney, Agent, or Firm*—Jack M. Wiseman

[57] ABSTRACT

A compact outdoor cooking unit having a cooking mode and a transport and storage mode. The outdoor cooking unit has a foldable stove. In the cooking mode, the stove is in the extended state. A base plate of a firebox has a hook flange and the foldable stove has a releasable locking flange along the lower end of an end wall thereof. The locking flange of the stove is releasably secured to the hook flange of the base plate when the foldable stove is in an extended state for the cooking mode. The outdoor cooking unit also includes a base, a pan, and a griddle. In the transport and storage mode, the pan is seated on the base within the upstanding walls of the base. In the transport and storage state, a griddle seats on the pan with the depending walls of the griddle surrounding the pan. The base, the pan, and the griddle, respectively, have vertically aligned handle hooks. In the transport and storage state, a strap surrounds the base, the pan, and the griddle and passes through the vertically aligned handle hooks of the base, pan, and griddle for maintaining the outdoor cooking unit in a compact mode.

24 Claims, 10 Drawing Sheets

COMPACT OUTDOOR COOKING UNIT

BACKGROUND OF THE INVENTION

The present invention relates in general to outdoor cooking units and, more particularly, to a compact outdoor cooking unit.

In the patent to Hait, U.S. Pat. No. 4,508,094, issued on Apr. 2, 1989, for Convertible Cooking Unit, there is disclosed a cooking unit comprising a truncated pyramidal firebox and a similar support member disposed in interlocking relation. Accessories, such as grills and covers, are adapted to be arranged in several modes to provide different cooking arrangements and to enclose all the members in a compact form for storage or transporting.

The patent to Hait, U.S. Pat. No. 4,489,706, issued on Dec. 25, 1984, for Multi-Purpose Fuel Efficient Portable Stove/Heater discloses a portable stove/heater having folding legs on which is disposed a water pan.

The patent to Hait, U.S. Pat. No. 4,877,010, issued on Oct. 31, 1989, for Outdoor Cooking Unit With Disposable Component discloses an outdoor cooking unit in which a bendable, disposable and non-combustible member is employed. The disposable member is disposed within a firebox. Disposed within the disposable member are fuel elements. The walls of a collar disclosed therein are restricted by upstanding flanges of a base.

In the patent to Hait et al., U.S. Pat. No. 4,531,505, issued on Jul. 30, 1985, for Convertible Cooking Unit With An Oven, there is disclosed a cooking unit having a base for the cooking unit, which serves as an oven with a drawer. The walls of a collar disclosed therein are restricted by upstanding flanges of a base. The patent to Hait, U.S. Pat. No. 4,531,505, also discloses a foldable windbreak made of stainless steel. The windbreak includes hingedly attached panels.

In the patent to Hait, U.S. Pat. No. 4,829,975, issued on May 16, 1989, for Cooking Unit With Improved Fire Grate, there is disclosed a cooking unit with foldable legs. A fire grate is formed with slots configured to receive the narrow dimensioned section of a briquette. The walls surrounding the slots support the briquette in vertical orientation with the narrow dimensioned section of the briquette extending upwardly. The walls of a collar disclosed therein are restrained by upstanding walls of a base. The patent to Hait, U.S. Pat. No. 4,829,975, also discloses a foldable windbreak made of stainless steel. The windbreak includes three panels hingedly attached. In addition, a hood is disclosed therein that is seatable on a cook grill.

The patent to Hull, U.S. Pat. No. 1,587,157, issued on Oct. 27, 1924, for Camp Stove Outfit discloses a collapsible camp stove adapted to burn gasoline or similar fluid fuel.

The patent to Forniti et al., U.S. Pat. No. 3,103,160, issued on Sep. 10, 1963, for Picnic Grill discloses a portable stove in which burners operate on fuel from a small propane container. The patent to Forniti et al. also discloses carrying handles formed of wire bails with wooden grips that are snapped into holes in the front and back of the portable stove.

In the patent to Voss, U.S. Pat. No. 2,645,993, issued on Jul. 21, 1953, for Portable Collapsible Smoke Apparatus, there is disclosed a smoke apparatus with foldable legs that extend outwardly and downwardly in the support position.

In the patent to Tufts, U.S. Pat. No. 3,384,066, issued on May 21, 1968, for Charcoal Burner, there is disclosed a handle connected to a retaining rod, which, in turn, supports a grate.

The patent to Mollere, U.S. Pat. No. 3,682,154, issued on Aug. 8, 1972, for Portable Disposable Charcoal Grill, discloses a portable charcoal grill lined with aluminum foil. The complete grill can be collapsed in a relatively small, rectangular package with the elements nested together. The base has upstanding flanges along the perimeter thereof and is used as a food warmer. The top is used for cooking food. The basic body of the grill can be collaped because of opposing vertical folds provided within its sides.

In the patent to Latouf, U.S. Pat. No. 4,149,514, issued on Apr. 14, 1979, for Barbeque Burner, there is disclosed a barbeque burner having a truncated, upright housing with slots along the top thereof. The walls of the housing are hingedly connected for folding.

Pyromid, Inc. has sold an Eagle outdoor cooking unit and has distributed advertising literature dated 1991 entitled "Pyromid's Eagle Outdoor Cooking System", which discloses a grill lifter and a handle attached to a hood. The Eagle outdoor cooking unit employed a hood as a shield from the wind and included an oven.

SUMMARY OF THE INVENTION

An object of the present invention is to provide a compact outdoor cooking unit that can be transported and stored with facility and easily assembled.

Another object of the present invention is to provide a compact outdoor cooking unit that has versatility in fuel usage.

A feature of the present invention is a detachable handle for lifting various cooking utensils of the outdoor cooking unit, such as a firebox heater, a pan, a base, and a griddle.

Another feature of the present invention is an arrangement for securely holding the foldable side walls of the stove securely in position when the stove is in an extended, upright position.

Another feature of the present invention is the employment of a disposable metallic windbreak for reducing heat losses during a cooking operation while the wind is blowing.

DESCRIPTION OF THE PREFERRED EMBODIMENTS

Figure 1:
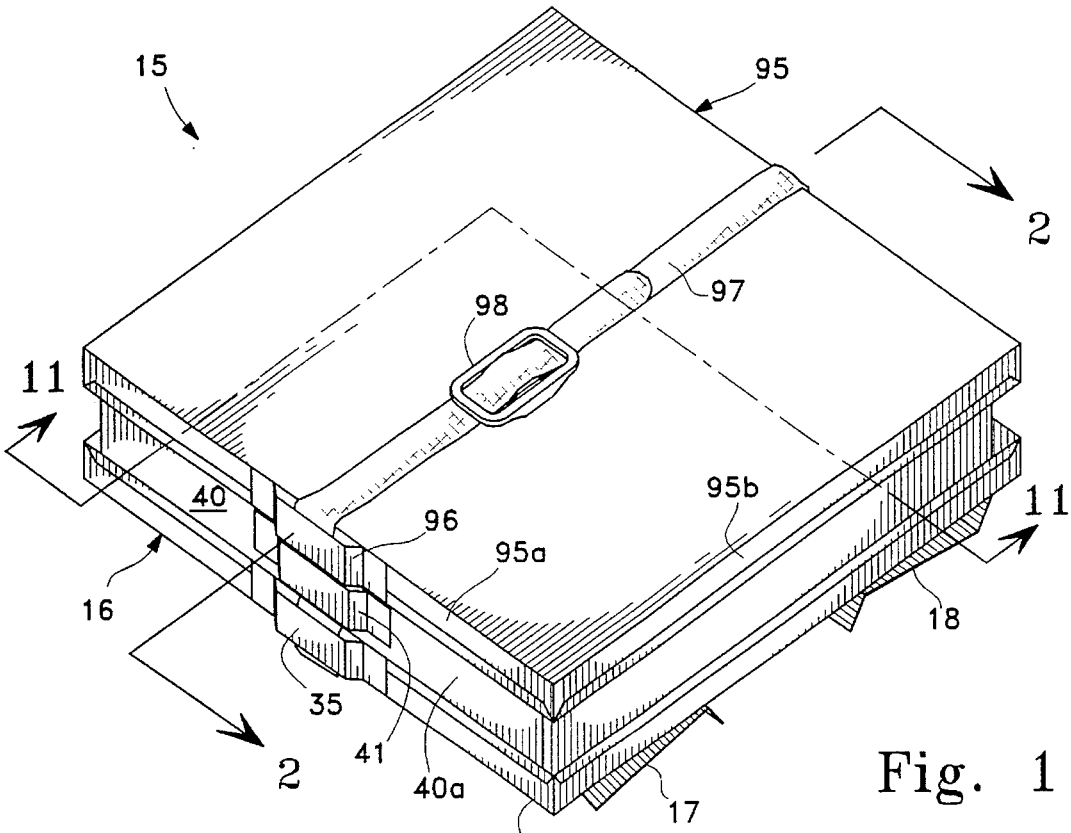
FIG. 1 is a diagrammatic perspective view of an outdoor cooking unit embodying the present invention shown in a compact transporting and storing mode.
Figure 2:
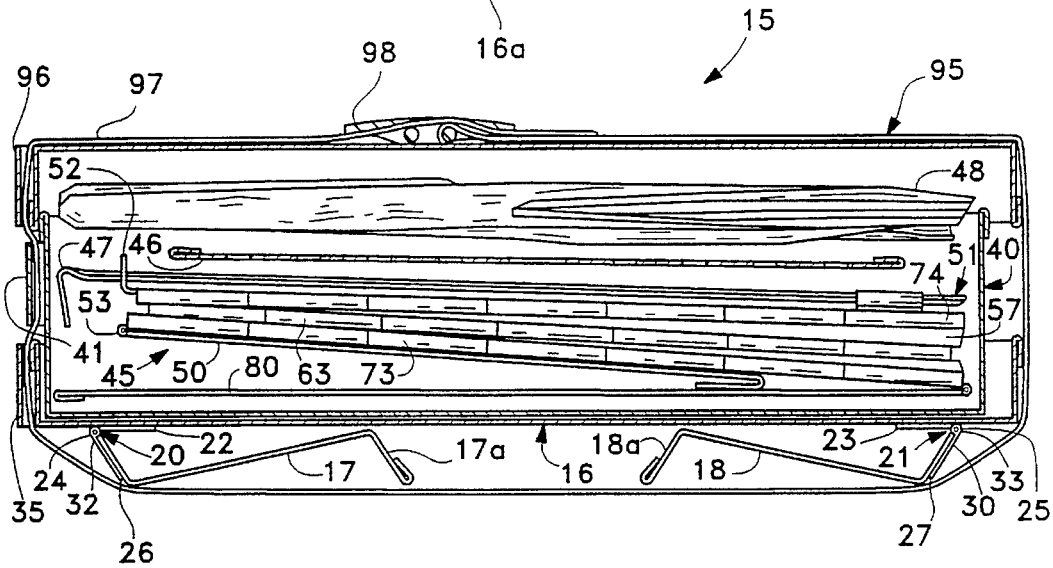
FIG. 2 is a diagrammatic vertical sectional view taken along line 2—2 of FIG. 1 illustrating the arrangement of the components of the outdoor cooking unit in the compact transporting and storing mode.

Illustrated in FIGS. 1 and 2 is the compact outdoor cooking unit 15 embodying the present invention shown in the transporting and storing mode. The outdoor cooking unit 15 comprises a base 16 having foldable legs 17 and 18 along opposite sides thereof. In the exemplary embodiment, the base 16 is made of stainless steel and has the configuration of a square. The legs 17 and 18 are in the retracted position during the transporting and storing of the outdoor cooking unit 15 so that the free ends of the legs 17 and 18 are adjacent the lower wall of the base 16. The legs 17 and 18 have a generally Z-shape configuration in cross-sectional area. Lower foot flanges 17*a* and 18*a* of the foldable legs 17 and 18, respectively, engage a supporting surface for the outdoor cooking unit 15, when the legs 17 and 18 are extended for the cooking mode.

Figure 9:
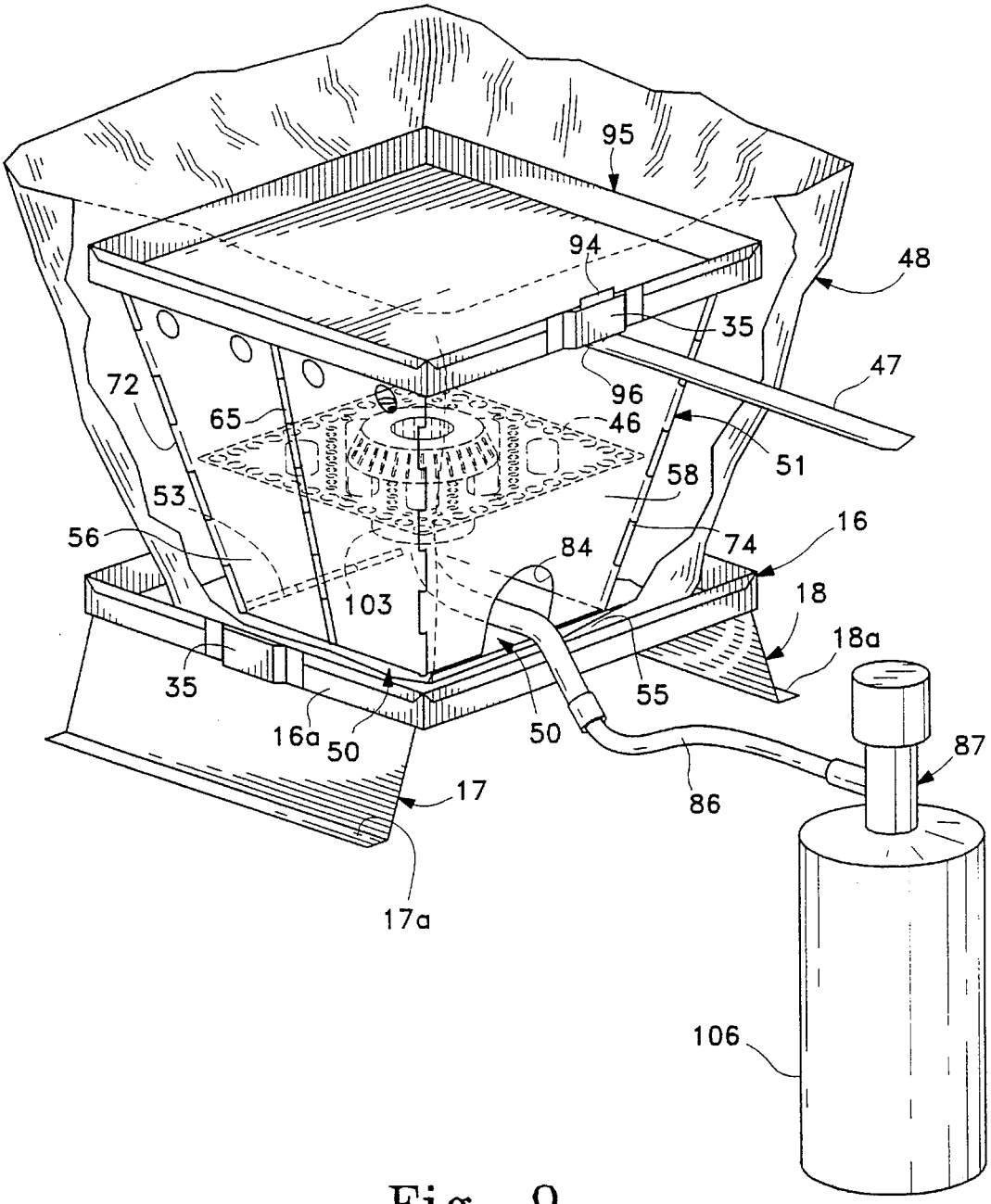
FIG. 9 is a diagrammatic perspective view of the outdoor cooking unit embodying the present invention in the cooking mode illustrated with the griddle as a cooking utensil and illustrated with a gaseous fuel for igniting and burning briquettes.
Figure 11:
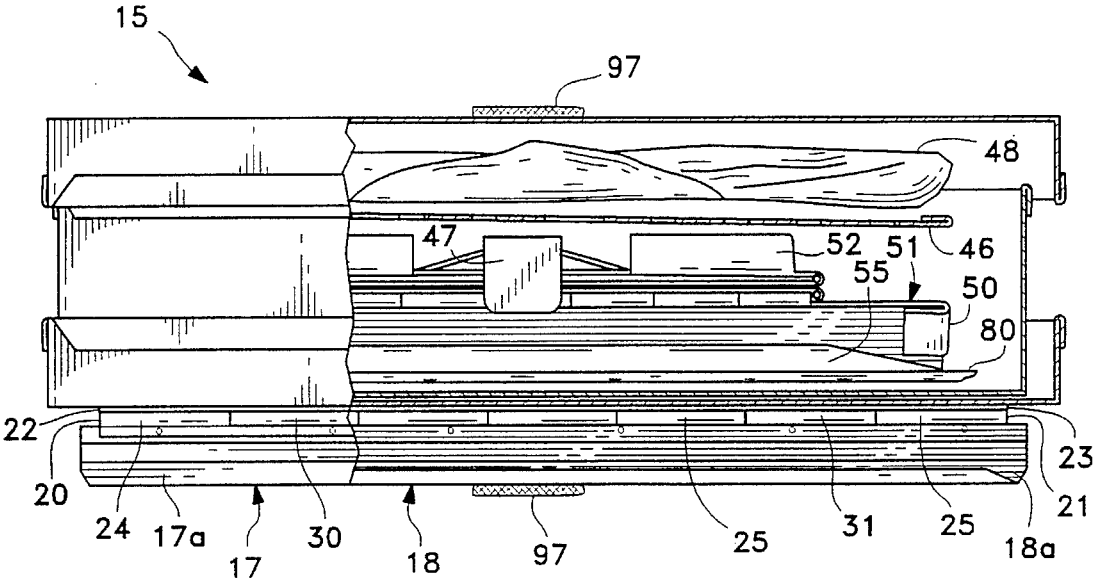
FIG. 11 is a vertical view, partially in section and partially in elevation, taken along lines 11—11 of FIG. 1.

The legs 17 and 18 are hinged to the lower wall of the base 16 by suitable hinges 20 and 21, respectively. In the exemplary embodiment, the hinges 20 and 21 include upper flanges 22 and 23, respectively, which are fixedly secured by rivets to the lower wall of the base 16. The hinges 20 and 21 include, in the exemplary embodiment, successively spaced tubes 24 and 25 (FIG. 9). The hinges 20 and 21 also include flanges 26 and 27 (FIG. 2), respectively, which are fixedly secured to the foldable legs 17 and 18, respectively, at the upper ends thereof by rivets. The flange 17*a* and the flange 26 are oppositely directed. Similarly, the flange 18*b* and the flange 27 are oppositely directed. The flanges 26 and 27, respectively, include successively spaced tubes 30 and 31, which are interposed between the successively spaced tubes 24 and 25, respectively (FIGS. 2 and 11). A hinge pin 32 is received by the tubes 24 and 30, and a hinge pin 33 is received by the tubes 25 and 31.

In the preferred embodiment, a U-shaped handle hook or gripper 35 (FIGS. 1 and 2) is secured to an upright wall 16*a* of the base 16 for removably securing the distal end of a handle to be described hereinafter. The base 16 has upright walls along the perimeter thereof, one of which 16*a* has the handle hook 35 secured thereto. In the exemplary embodiment, the handle hook 35 has the intermediate section thereof outwardly spaced from an upright wall 16*a* of the base 16 to which it is secured. The handle hook 35 is riveted, in the exemplary embodiment, to the upright wall 16*a* of the base 16 at the opposite ends thereof.

The outdoor cooking unit 15 comprises a pan 40. In the exemplary embodiment, the pan 40 is made of stainless steel and has a square configuration. When in the transport and storing mode, the pan 40 seats within the base 16 with the open top thereof spaced from the base 16 and with the bottom thereof engaging the base 16. Along the perimeter thereof, the pan 40 has upstanding walls. In the preferred embodiment, a U-shaped handle hook or gripper 41 is secured to one of the upstanding walls of the pan 40. The upstanding walls of the pan 40 are disposed along the perimeter of the pan 40. The handle hook 41 has the intermediate section thereof outwardly spaced from wall 40*a* to which it is secured. The handle hook 41 is riveted, in the exemplary embodiment, to the upright wall 40*a* of the pan 40. When in the transport and storing mode, the handle hook 41 is disposed generally in vertical alignment with the handle hook 35 of the base 16. When the pan 40 is used for cooking, the walls along the perimeter thereof extend upwardly from the bottom wall and define the top for the pan 40.

Figure 3:
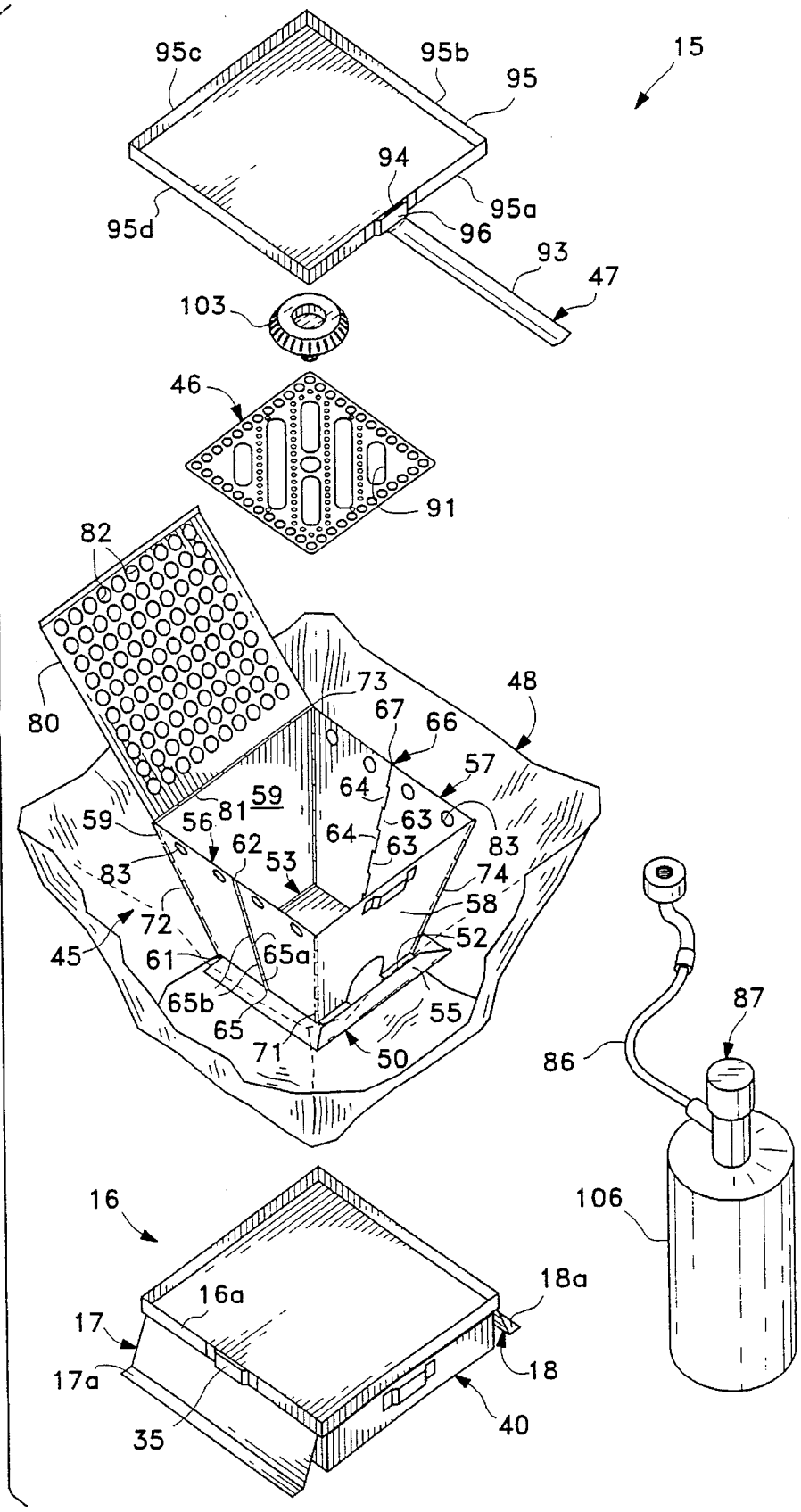
FIG. 3 is a diagrammatic exploded perspective view of the outdoor cooking unit embodying the present invention illustrated with a griddle as a cooking utensil and illustrated with a gaseous fuel for igniting and burning briquettes.
Figure 4:
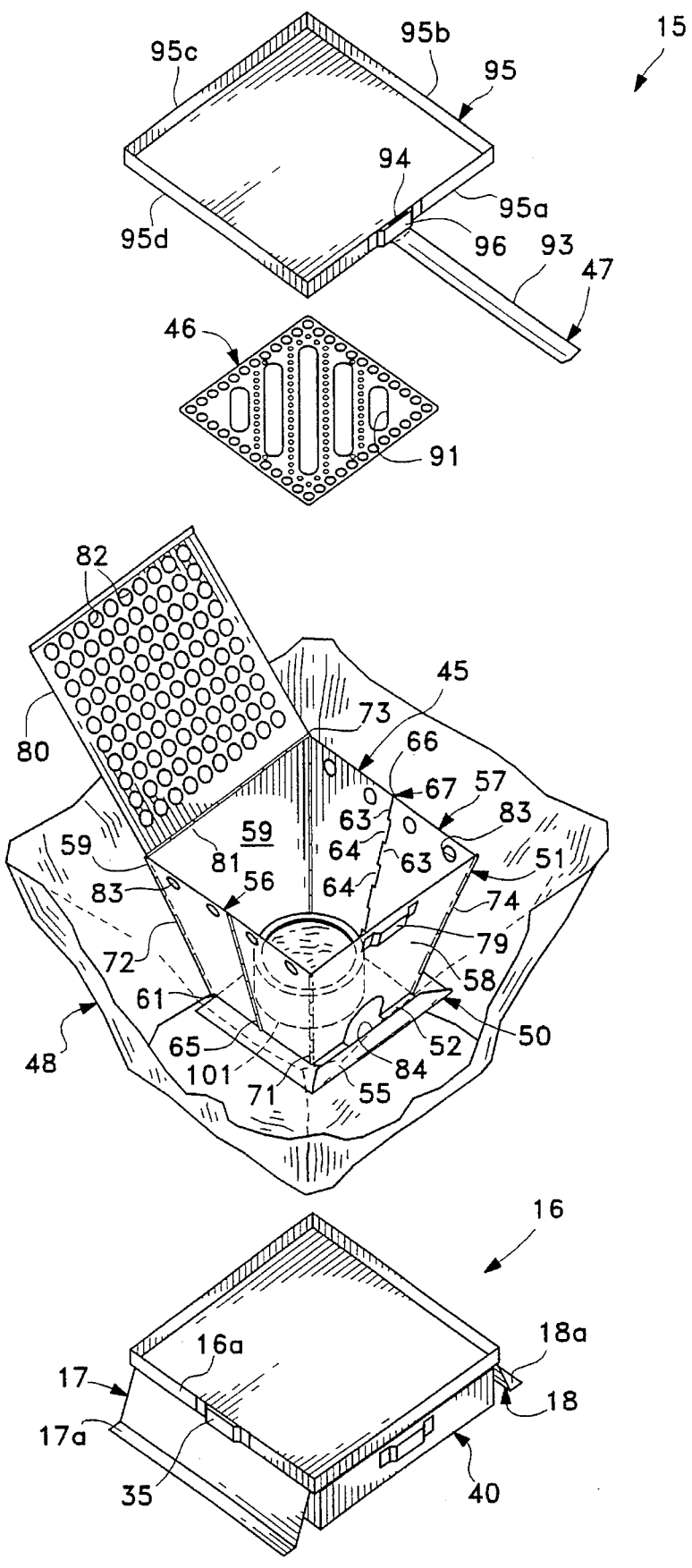
FIG. 4 is a diagrammatic exploded perspective view of the outdoor cooking unit embodying the present invention illustrated with the griddle as a cooking utensil and illustrated with a solid fuel for igniting and burning briquettes.
Figure 5:
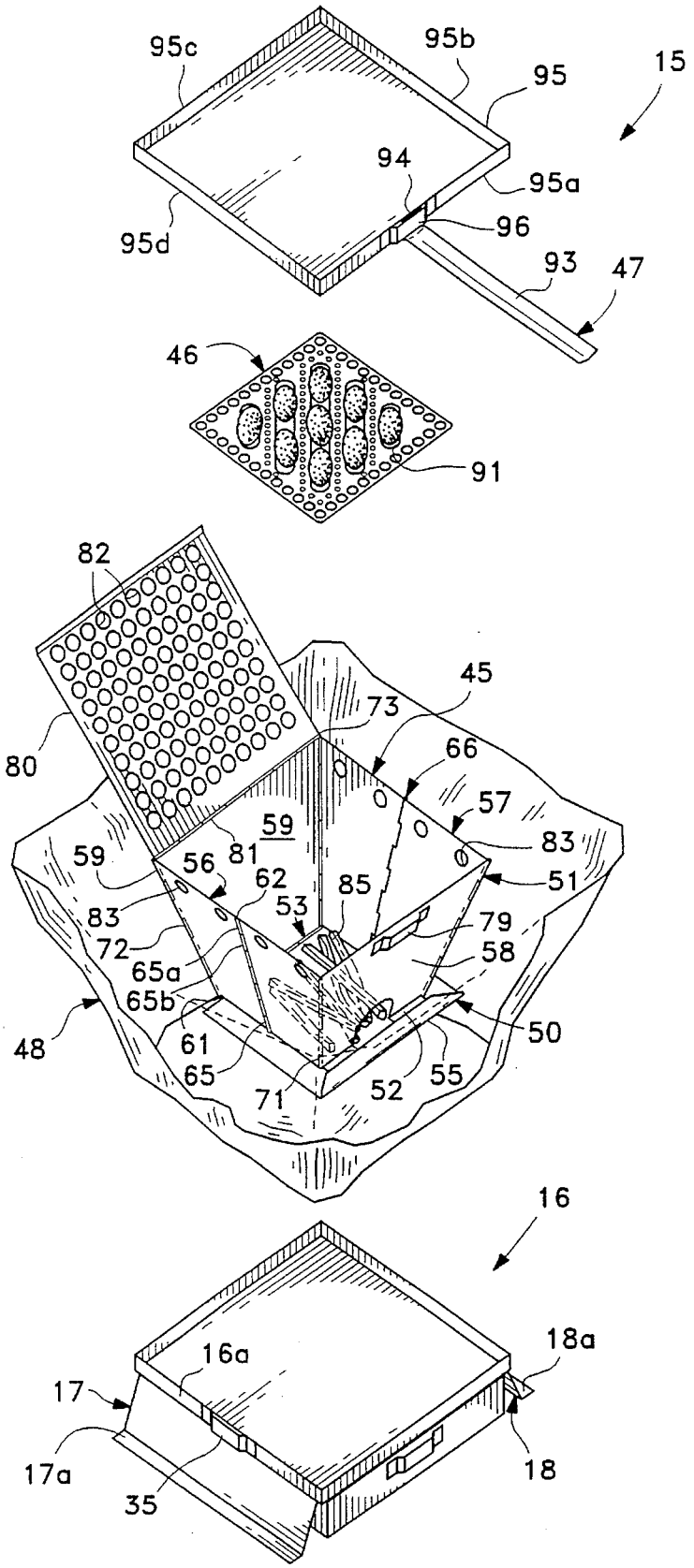
FIG. 5 is a diagrammatic exploded perspective view of the outdoor cooking unit embodying the present invention illustrated with the griddle as a cooking utensil and illustrated with fuel sticks for igniting and burning briquettes.
Figure 6:
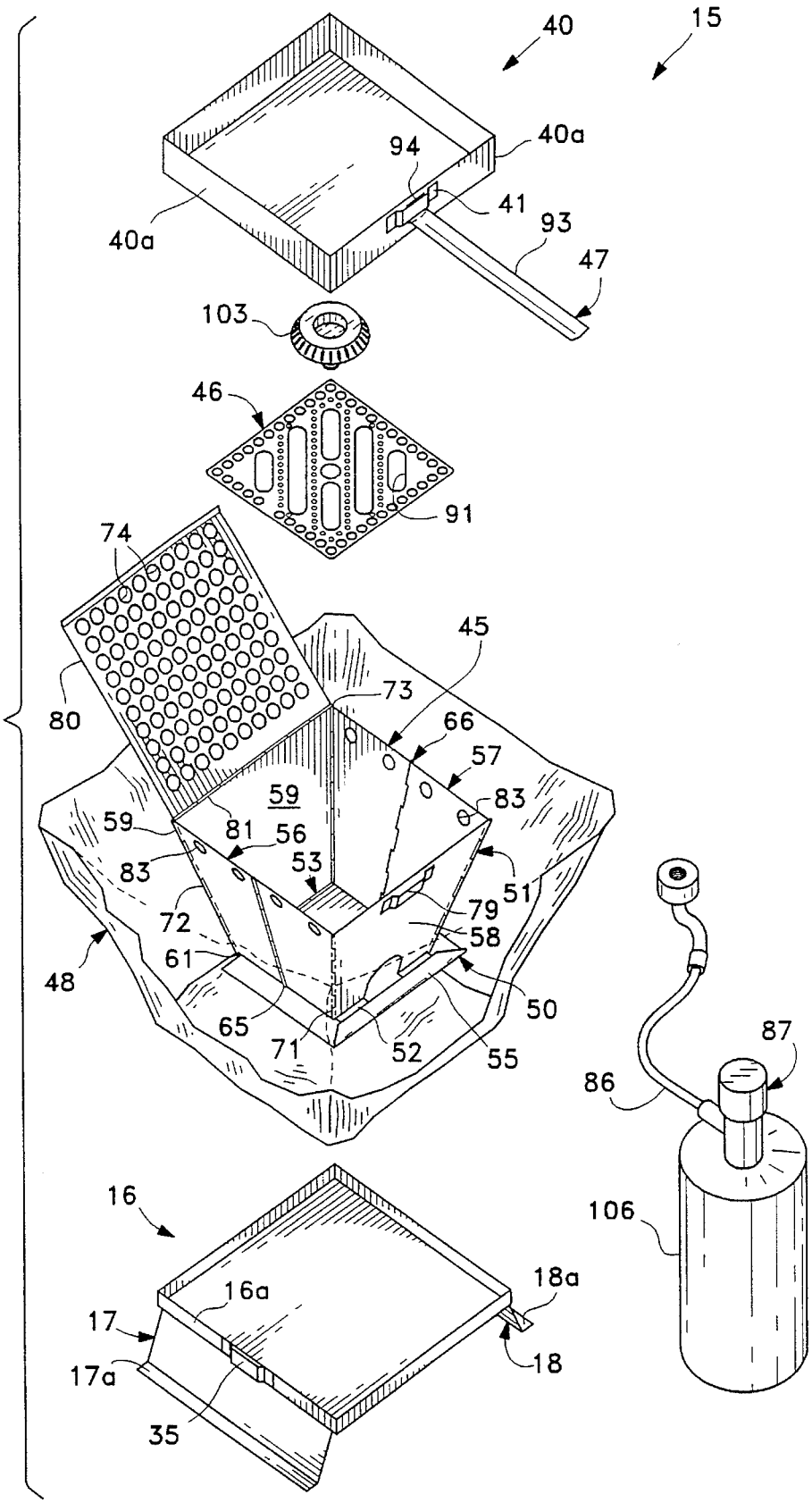
FIG. 6 is a diagrammatic exploded perspective view of the outdoor cooking unit embodying the present invention illustrated with a pan as a cooking utensil and illustrated with a gaseous fuel for igniting and burning briquettes.
Figure 7:
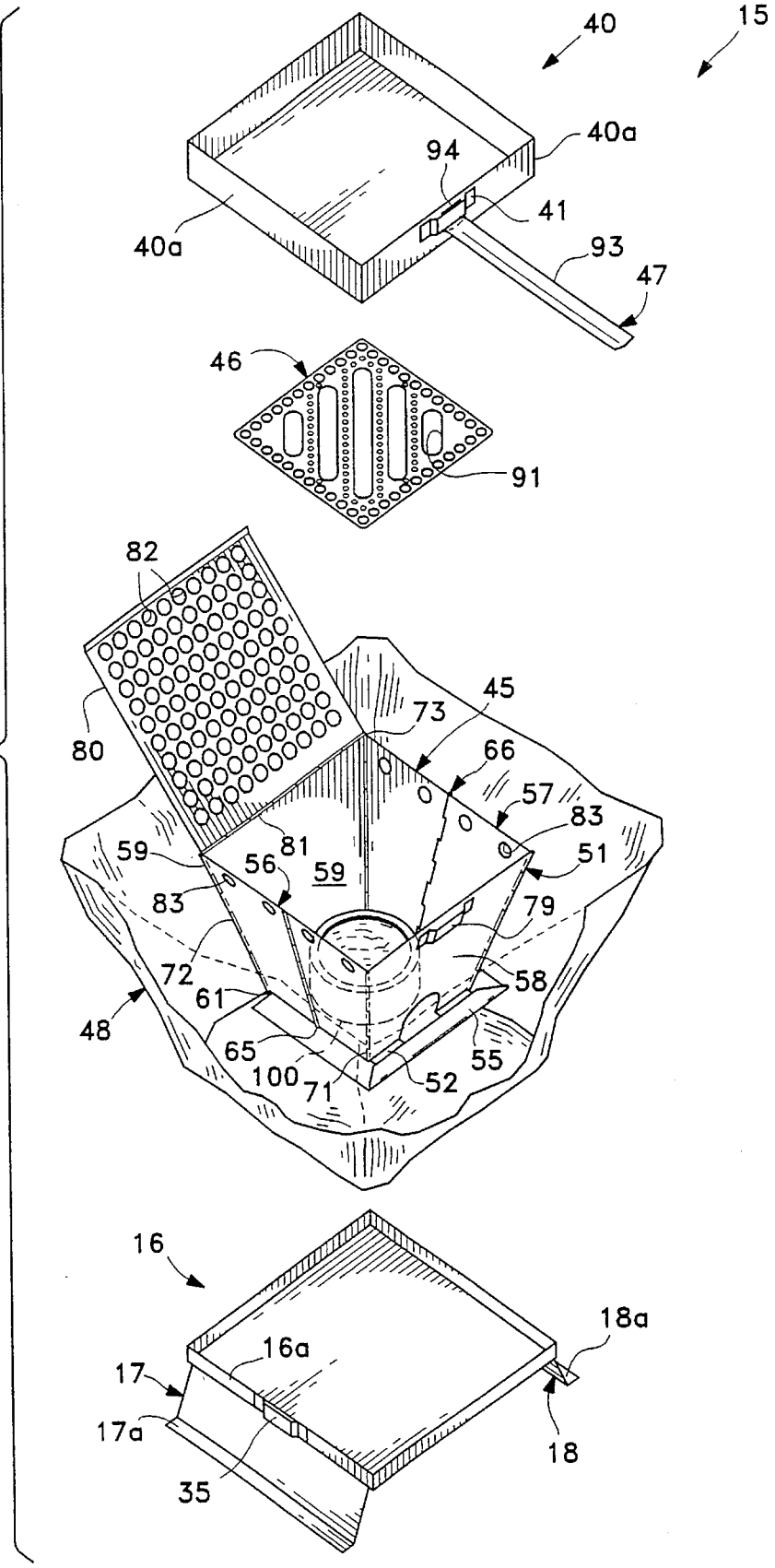
FIG. 7 is a diagrammatic exploded perspective view of the outdoor cooking unit embodying the present invention illustrated with a pan as a cooking utensil and illustrated with a solid fuel for igniting and burning briquettes.
Figure 8:
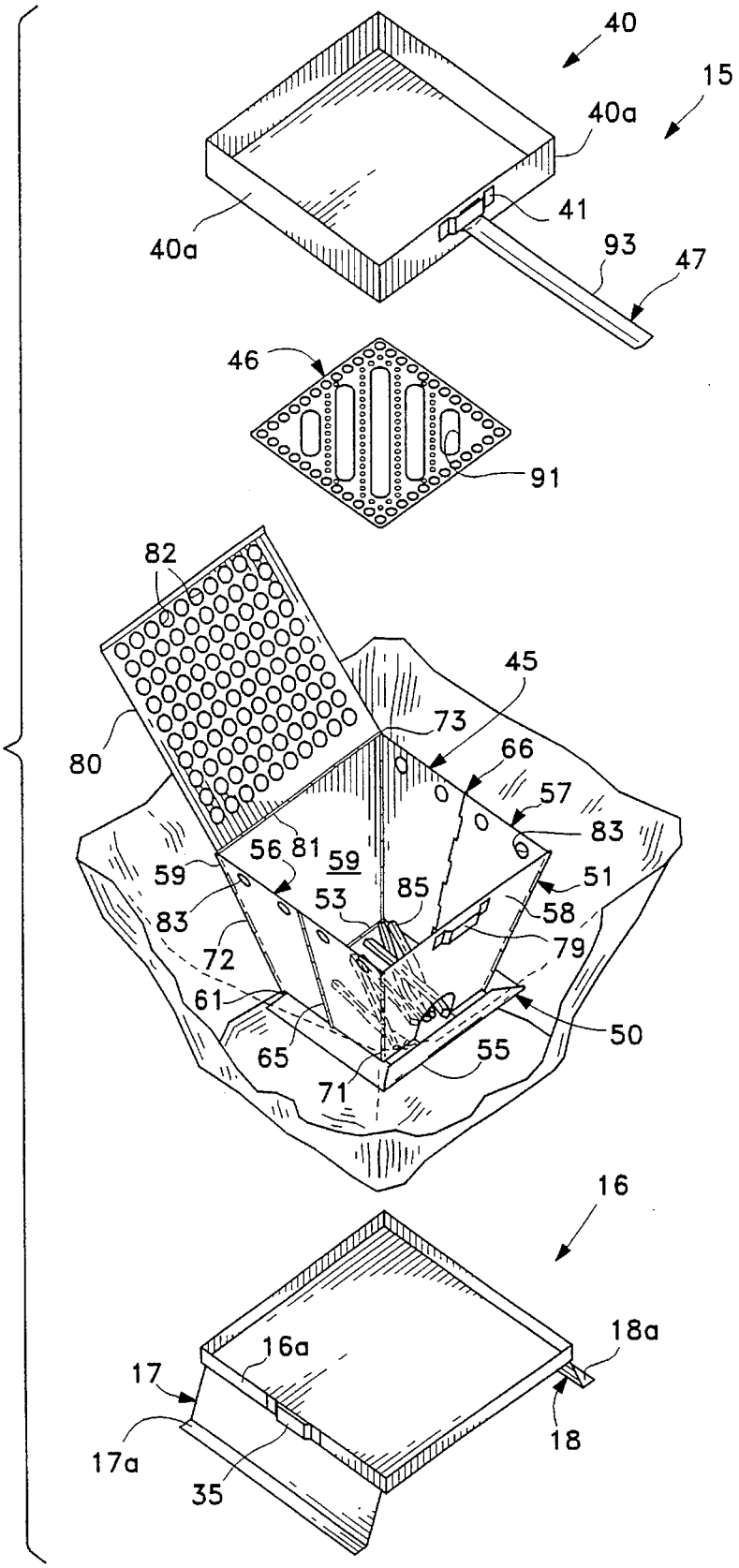
FIG. 8 is a diagrammatic exploded perspective view of the outdoor cooking unit embodying the present invention illustrated with a pan as a cooking utensil and illustrated with fuel sticks for igniting and burning briquettes.
Figure 12:
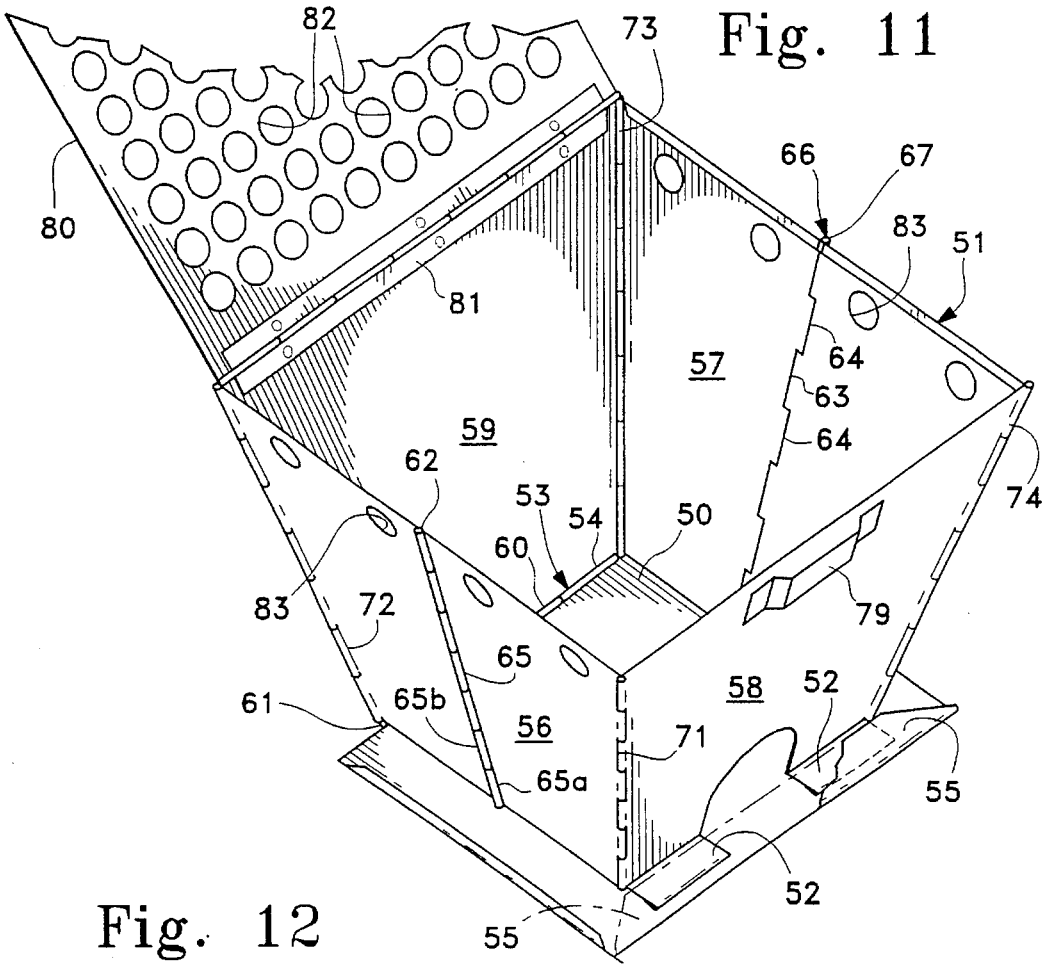
FIG. 12 is an enlarged, fragmentary perspective view of a stove and a base plate employed in the outdoor cooking unit of the present invention broken away to illustrate the locking arrangement between the stove and the base plate when the outdoor cooking unit is in a cooking mode.

Stored in the pan 40, when the outdoor cooking unit 15 is in the transport and storing mode, are a folded firebox 45, a fire grate 46 for the holding of briquettes, a handle 47, and a disposable metallic windbreak 48 for the firebox 45 (FIG. 2). The firebox 45, which is made of stainless steel, comprises a base plate 50 having a square configuration, in the exemplary embodiment. In addition thereto, the firebox 45 comprises an inverted, pyramidal, foldable stove 51. Foldable fireboxes are described in the patent to Hait, U.S. Pat. No. 4,508,094 issued on Apr. 1, 1989, for Convertible Cooking Unit. In the preferred embodiment, the foldable stove 51 is formed with an outwardly extending releasable locking flange 52 along an end wall 58 (FIGS. 3 and 12). When the foldable stove 51 is in the extended state for the outdoor cooking unit to be in a cooking mode, the flange 52 is received by a hook flange 55. The hook flange 55 is integrally formed with the base plate 50 and is spaced therefrom at its free end at a height sufficient to receive the flange 52 and to releasably lock the flange 52 in position while the foldable stove 51 is in the extended state for the outdoor cooking unit to be in a cooking mode. When the stove 51 is folded for storing in the pan 40, the flange 52 is removed from the hook flange 55.

An end wall 59 of the foldable stove 51 is hingedly attached to the base plate 50 by a hinge 53. The flange 52 of the foldable stove 51 extends from the opposite end wall 58 of the base plate 50. The base plate 50 along an edge thereof has secured thereto by suitable means, such as a flange and rivets, successively spaced tubes 54 (FIG. 12). Along the end wall 59 of the stove 51 at the lower edge thereof are secured by suitable means, such as a flange and rivets, successively spaced tubes 60, which are disposed successively between spaced tubes 54. A pin 61 is received by the tubes 54 and 60.

For folding and unfolding the stove 51, opposite side walls 56 and 57 of the stove 51 are hinged vertically midway between the ends of the side walls 56 and 57, respectively.

A hinge 65 is disposed at the confronting sections of the side wall 56. The hinge 65 includes generally vertically aligned, successive, spaced tubes 65*a* integrally formed at the confronting end of one section of the side wall 56. The other confronting end of the other section of the side wall 56 also includes generally vertically aligned, successive tubes 65*b* integrally formed therewith. The tubes 65*a* of one section of the side wall 56 are spaced between the tubes 65*a* of the other section of the side wall 56 successively. A generally vertical hinge pin 62 is received by the tubes 65*a* and 65*b* of both sections of the side wall 56.

Likewise, the opposite side wall 57 generally vertically midway between the ends thereof has a generally vertical hinge 66 at the confronting sections of the side wall 57 for the folding and extending of the stove 51. The side wall 57 includes generally vertically disposed, successive, spaced tubes 63 integrally formed at the confronting end of one section of the side wall 57. The other confronting end of the other section of the side wall 57 also includes generally vertically aligned, successive tubes 64 integrally formed therewith. The tubes 63 of the one section of the side wall 57 are spaced between the tubes 64 of the other section of the side wall 57, successively. A generally vertical hinge pin 67 is received by the tubes 63 and 64 of both sections of the side wall 57.

As previously described, the stove 51 also includes the end wall 58 which is opposite the end wall 59. Each side of the walls 56, 57, 58 and 59 is hinged to its adjacent conjoined side for the folding and extending of the stove 51. Toward this end, the side walls 56 and 57 are hingedly attached to the adjoining sides of the confronting ends of end walls 58 and 59. Thus, at the corners of the stove 51 are generally vertical hinges 71–74, respectively. The construction of the hinges 71–74 are similar to the construction of the hinges 65 and 66 heretofore described in detail.

A suitable cooking grill 80 (FIGS. 3–8) made of stainless steel is hingedly attached to the stove 51 along the upper edge of the end wall 58 by a suitable hinge 81. The hinge 81 for hingedly attaching the cooking grill 80 to the stove 51 is constructed in a manner previously described for the hinge 53. When the outdoor cooking unit is stored in the pan 40, the walls 56, 57, 58 and 59 fold in overlying arrangement. Then, the base plate 50 is folded outwardly to engage the end wall 59. The cooking grill 80 is folded along the outwardly disposed base plate 50.

The cooking grill 80 is suitably apertured in rows and columns by openings 82 (FIGS. 3–8). In the exemplary embodiment, combustion air openings 83 are formed at the top of the side walls 56 and 57 of the stove 51. Along the top of the end wall 58 is a U-shaped handle hook or gripper 79. The handle hook 79 is secured to the end wall 58 at the ends of the handle hook 83. The handle hook 79 is spaced intermediate its ends from the end wall 58 to which it is secured and is riveted.

Formed in the lower end of the end wall 58 is a suitable port 84 (FIGS. 9 and 10) for the insertion of fuel sticks 85 (FIGS. 5 and 8) or a fuel line 86 (FIGS. 9 and 10) for a suitable gaseous fuel heating system, such as a portable butane or propane burner 87.

When the cooking unit 15 is in a transport and storing mode, the fire grate 46 is disposed in the pan 40 above the stove 51 (FIG. 2). When the cooking unit 15 is in a cooking mode, the fire grate 46 (FIGS. 9 and 10) is disposed within the extended foldable stove 51 intermediate the top and the bottom of the stove 51 for supporting fuel, such as briquettes. The fire grate 46 also serves to rigidify the stove 51 when the stove 51 is in an extended state for the cooking mode. The fire grate 46 has, in the exemplary embodiment, a square configuration, and abuts against the walls 56–59 of the inverted, pyramidal stove 51 to be supported thereby, when the stove 51 is extended and the cooking unit 15 is in a cooking mode.

The patent to Hait, U.S. Pat. No. 4,829,975, issued on May 16, 1989, for Cooking Unit With Improved Fire Grate, discloses generally the fire grate 46. In the exemplary embodiment, the fire grate 46 is formed with slots 91 (FIGS. 3–8) configured to receive the narrowed dimensional section of the briquettes. The walls surrounding the slots 91 support the briquettes in vertical orientation with the narrow dimensioned sections of the briquettes extending upwardly. Combustion air or gas flows though the slots 91 for exposing the briquettes to the combustion air or gas. When the fire grate 46 is used in conjunction with the portable butane burner or propane burner 87, a central opening is provided in the fire grate 46 to receive a connector tube of a gas burner fitting head 103. The gas fitting head 103 seats on the fire grate 46. The connector tube is secured at one end to the gas burner fitting head 103 in a suitable manner such as by welding, so that gas from the portable butane burner or propane burner 87 can be fed to the gas fitting head 103. The other end of the tube is connected by threaded engagement to a suitable connector that is disposed below the fire grate 46. A suitable hose 86 is attached at one end to the connector in communication with the connector tube and is attached at the other end to a gas storing cylinder or tank 106 of the portable butane burner or propane burner 87 in communication with the gas storing cylinder or tank 106.

When the cooking unit 15 is in a transport and storing mode, a bendable, disposable and non-combustible metallic windbreak 48 (FIG. 2) in a folded state is stored in the pan 40. The metallic windbreak 48, in the exemplary embodiment, is made of metallic paper, such as tempered aluminum foil having a thickness within the gauge range of 0.001 of an inch to 0.005 of an inch. The tempering is in the range of 50% to 100%. The metallic windbreak 48 (FIGS. 3–8), when extended for the cooking mode, has upstanding panels to form an inverted, truncated, pyramidal configuration with an open top. The height of the metallic windbreak 48 extends generally to the combustion air openings 83 formed in the side walls 56*a* and 57 of the stove 51 in spaced relation to the firebox 45 when the cooking unit 15 is in the extended state for the cooking mode. The windbeak 48 reduces heat loss during the cooking operation while the wind is blowing.

The handle 47, in the exemplary embodiment, is made of suitable metal, such as steel. The handle comprises a shaft 93 that is gripped by the user of the cooking unit 15. At one end of the shaft 93 is right angle flange 94 suitable for removably gripping the handle hooks 35, 41 and 79, respectively, from the bottom thereof and extending upwardly in the space formed by the spaced sections of the handle hooks 35, 41 and 79. The handle hooks 35, 41 and 79 are removably gripped, respectively, by the shaft 93 and the flange 94 for lifting the base 16, the pan 40, and the stove 51, respectively.

When the outdoor cooking unit is in a transport or storing mode, a griddle 95 (FIG. 1) seats on the pan 40 in overlying relation. The griddle 95, in the exemplary embodiment, is made of stainless steel and has a square configuration. Formed along the perimeter of the griddle 95 are depending walls 95*a*–95*d* (FIGS. 3–8) when the outdoor cooking unit 15 is in transport and storing mode. When the griddle 95 is used for cooking, the walls 95*a*–95*d* are upstanding from a closed bottom and define open top for the griddle 95.

A handle hook 96 (FIG. 1) is secured to the wall 95*a* of the griddle 95 by suitable means, such as rivets. The handle hook 96 is secured at the ends thereof to the wall 95*a* of the griddle 95 and is spaced at the center section thereof from the wall 95*a* to receive the handle 47. The handle hook 96 is disposed in vertical alignment with the handle hooks 35 and 41, when the outdoor cooking unit 15 is in a transport and storing mode. The handle hook 96 of the griddle 95 is removably gripped by the shaft 93 and the flange 94 of the handle 47 for lifting the griddle 95.

A suitable strap 97 is disposed about the stacked base 16, pan 40 and griddle 95 in locking arrangement when the outdoor cooking unit 15 is in a transport and storing mode. In the exemplary embodiment, the strap 97 passes through the handle hooks 35, 41 and 96 when the outdoor cooking unit 15 is in a transport and storing mode. A suitable clasp 98 at one end of the strap 97 maintains the strap in a taut state when the outdoor cooking unit 15 is in a transport and storing mode.

When the outdoor cooking unit 15 is in a transport and storing mode (FIGS. 1 and 2), the foldable legs 17 and 18 are retracted so that the free ends thereof are adjacent the bottom wall of the base 16. Seated within the perimetric upstanding walls of the base 16 is the pan 40. The handle hook 41 of the pan 40 is vertically aligned with the handle hook 35 of the base 16. The closed bottom of the pan 40 is adjacent the bottom wall of the base 16 and the open top of the pan 40 is spaced from the bottom of the base 16. Disposed within the pan 15 to engage the bottom wall thereof is the folded firebox 45. The flange 52 of the foldable stove 51 is removed from the hook flange 55 of the base plate 50. The stove 51 is folded so that the side walls 56 and 57 thereof are sandwiched between the end walls 58 and 59 (FIG. 2). The base plate 50 of the foldable stove 51 is folded to engage the end wall 59 of the foldable stove 51. The cooking grill 80 is folded beneath the base plate 50.

When disposed in the pan 40, the cooking grill 80 engages the bottom wall of the pan 40. The fire grate 46 is disposed on the folded firebox 45. On top of the fire grate 46 is disposed the folded flexible windbreak 48. The handle 47 is positioned within the pan 40 adjacent to the folded firebox 45 with the flange 94 thereof directed toward the interior of the pan 40. Seated on the pan 40 in overlying relation thereto is the griddle 95. The depending walls of the griddle 95 surround the pan 15 and the opening of the griddle 95 receives the pan 40. The handle hook 96 of the griddle 95 is vertically aligned with the handle hooks 41 and 35. The strap 97 engages the stacked base 16, pan 40 and griddle 97 to hold the same together for transporting and storing. The strap 97 passes through the handle hooks 96, 41 and 35. The clasp 94 maintains the strap 96 in a taut state to hold the outdoor cooking unit 15 in the stacked state for transporting and storing.

Figure 10:
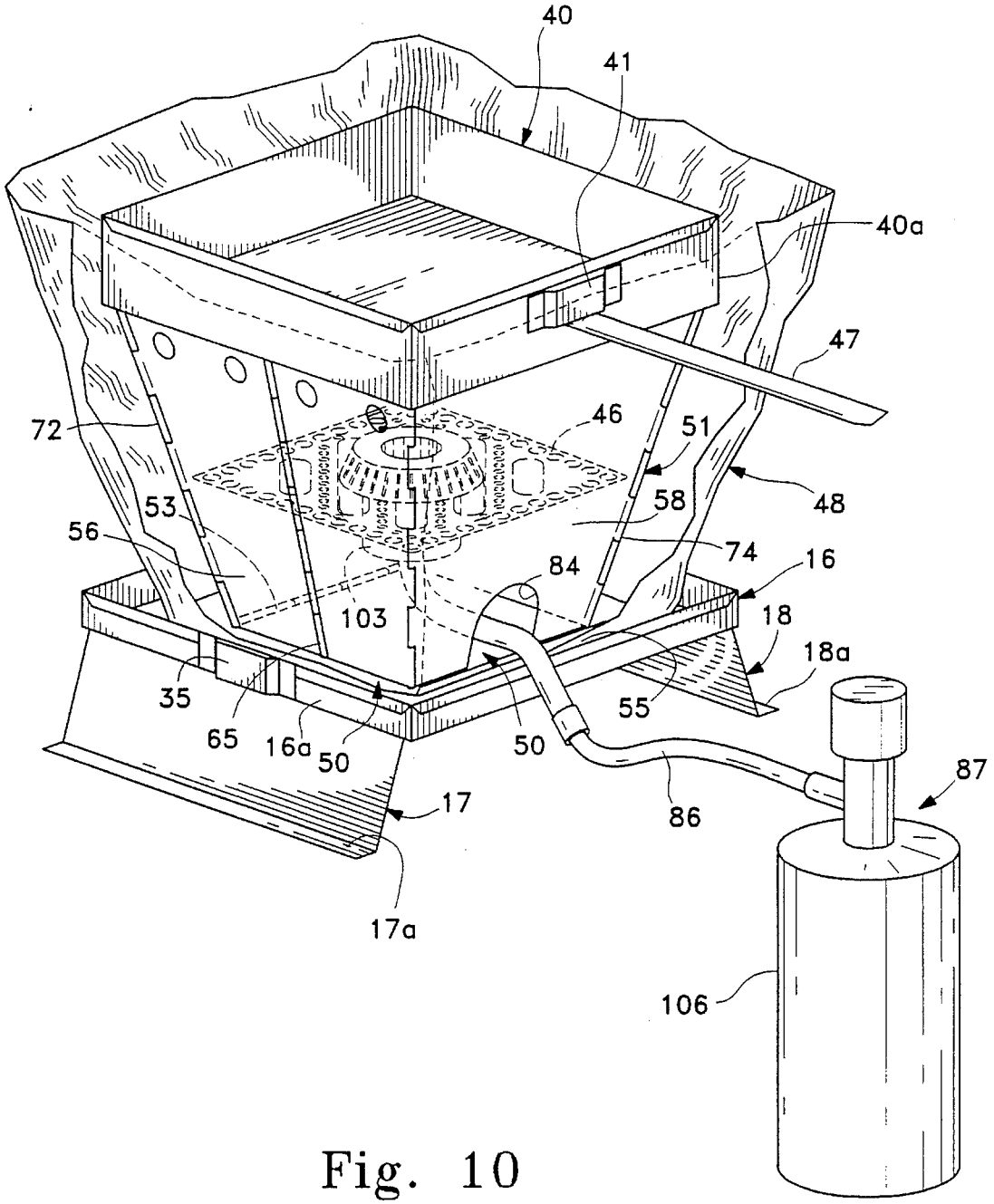
FIG. 10 is a diagrammatic perspective view of the outdoor cooking unit embodying the present invention in the cooking mode illustrated with the pan as a cooking utensil and illustrated with a gaseous fuel for igniting and burning briquettes.

When the outdoor cooking unit is in a cooking mode, the legs 17 and 18 of the base 16 are extended for the base 16 to be positioned on a supporting surface (FIGS. 9 and 10). The stove 51 of the firebox 45 is extended and the flange 52 is inserted into the hook flange 55 to hold the stove 51 in the extended state. Thereupon, the metal windbreak 48 is unfolded and seats on the base 16. The firebox 45, in the extended state, is disposed centrally within the metal windbreak 48 with the windbreak 48 in spaced relation to the stove 51. The panels of the metal windbreak 48 form generally an inverted, truncated pyramidal configuration. The fire grate 46 is disposed within the stove 51 intermediate the top and bottom thereof and engages the panels of the stove 51. The fire grate 46 supports the briquettes to be ignited in the stove 51 and rigidifies the stove 51 while in the extended state. The cooking grill 80 is pivoted to overlie the open top of the stove 51. The wall 59 supports the free end of the cooking grill 80.

Optionally, the griddle 95 is seated on the top of the stove 51 above the grill 80 (FIG. 9) as a cooking utensil. In the alternative, the pan 40 is seated on top of the stove 51 above the grill 80 (FIG. 10) as a cooking utensil. When the griddle 95 is seated on the top of the stove 51, the pan 40 may be inserted below the base 16 between the foldable legs 17 and 18 to serve as an oven.

For igniting the briquettes disposed on the fire grate 46, well-known fuel sticks 85 are positioned at the bottom of the stove 51 through the port 84 (FIGS. 5 and 8) for igniting and burning the charcoal or briquettes. Optionally, suitable solid fuel 101 in a metal container, such as Sterno or canned heat, may be seated on the base plate 50 of the firebox 45 (FIGS. 4 and 7) for igniting and burning the charcoals or briquettes. As a further option, the well-known gaseous fuel system 87 (FIGS. 3, 6, 9 and 10), such as a butane or propane heating system, may be employed for igniting and burning the charcoals or briquettes. The suitable gas burner fitting head 103 for the gaseous heating system 87 may be seated on the fire grate 46 of the stove 51. The line or hose 86 passes through the port 82 to interconnect the gas burner fitting head 103 with the tank 106 storing the gaseous fuel via the connector and depending tube of the gas burner fitting head 103. After the briquettes are burning, the solid fuel 101 is extinguished in a well-known manner and the flame of the gaseous fuel heating system 87 is extinguished in a well-known manner.

What is claimed is:

1. A firebox for an outdoor cooking unit comprising:

(a) a base plate having a sloping hook flange disposed along one side thereof; and (b) a foldable stove having a folded state for transporting and storage mode, said foldable stove having an extended state for a cooking mode, said foldable stove being hingedly attached to said base plate along an end wall thereof opposite to the side of said base plate having a sloping hook flange, said foldable stove comprising a releasable sloping locking flange along the lower end of an end wall thereof that is opposite the end wall thereof hinged to said base plate, said sloping locking flange of said foldable stove being received by and releasably secured to said sloping hook flange of said base plate in overlying sloping engagement when said foldable stove is in an extended state for the cooking mode.

2. A firebox for an outdoor cooking unit as claimed in claim 1 wherein said foldable stove has a four walled configuration when in the extended state and comprises opposite side walls, said opposite side walls being, respectively, hinged in a generally vertical direction intermediate the sides thereof for folding and for extending said foldable stove, each of said end walls of said foldable stove being respectively hinged in a generally vertical direction to said side walls of said foldable stove along the adjacent sides of said side walls for folding and extending said foldable stove.

3. A firebox as claimed in claim 2 and comprising a fire grate disposed in said foldable stove supported by said end and side walls of said foldable stove when said foldable stove is in an extended state.

4. A firebox as claimed in claim 3 and comprising fuel access means formed in one of said end walls for the passage of fuel into said foldable stove when said foldable stove is in the extended state for a cooking mode.

5. A firebox as claimed in claim 4 and comprising a handle hook secured to one of said end walls of said foldable stove.

6. A firebox as claimed in claim 3 and comprising a cooking grill hinged to said foldable stove along the top of said end wall of said foldable stove to which said foldable stove is hinged to said base plate, said cooking grill being hinged to said foldable stove above said fire grate.

7. An outdoor cooking unit in a compact mode for transporting and storage, said outdoor cooking unit comprising:

(a) a base with upstanding walls, said base comprising a handle hook attached to one of said upstanding walls of said base along an outer surface thereof;

(b) a first cooking utensil having upstanding walls, said first cooking utensil being seated on said base within said upstanding walls of said base, said first cooking utensil comprising a handle hook attached to one of said upstanding walls of said first cooking utensil along an outer surface thereof, said handle hook of said first cooking utensil being in vertical alignment with said handle hook of said base; and (c) a second cooking utensil having depending walls, said second cooking utensil being seated on said first cooking utensil, said depending walls of said second cooking utensil receiving said first cooking utensil within the depending walls of said second cooking utensil, said second cooking utensil comprising a handle hook attached to one of said depending walls of said second utensil along an outer surface thereof in vertical alignment with said handle hook of said base and the handle hook of said first cooking utensil.

8. An outdoor cooking unit as claimed in claim 7 and comprising a strap surrounding said base, said first cooking utensil, and said second cooking utensil and passing through said handle hooks of said base, said first cooking utensil and said second cooking utensil for maintaining said outdoor cooking unit in a compact mode for transporting and storage.

9. An outdoor cooking unit as claimed in claim 8 wherein said first cooking utensil is a pan and said second cooking unit is a griddle.

10. An outdoor cooking unit as claimed in claim 8 and comprising a folded firebox stored in said first cooking utensil.

11. An outdoor cooking unit as claimed in claim 10 and comprising a fire grate stored in said first cooking utensil and seated on said folded firebox.

12. An outdoor cooking unit as claimed in claim 11 and comprising a handle stored in said first cooking utensil and disposed adjacent said folded firebox.

13. An outdoor cooking unit as claimed in claim 12 and comprising a folded metal windbreak stored within said first cooking utensil and seated on said fire grate.

14. An outdoor cooking unit as claimed in claim 10 wherein said folded firebox comprises a base plate and a folded stove.

15. An outdoor cooking unit as claimed in claim 14 wherein said folded stove has opposite side walls and opposite end walls, one of said end walls of said folded stove being hingedly attached to said base plate for folding said base plate into engagement with said one end wall of said folded stove, each of said side walls of said folded stove being hinged in a generally vertical direction intermediate the sides thereof for folding said side walls of said folded stove, each of said side walls of said folded stove being hinged in a vertical direction to said end walls of said folded stove along the adjacent sides of said end walls of said folded stove for folding said end walls and said side walls of said folded stove into adjacent relation to one another with said side walls of said folded stove sandwiched between said end walls of said folded stove.

16. An outdoor cooking unit as claimed in claim 15 and comprising a cooking grill hinged to said one end wall of said folded stove which is hingedly attached to said base plate for folding said cooking grill adjacent said base plate.

17. An outdoor cooking unit as claimed in claim 16 and comprising a fire grate stored in said first cooking utensil and seated on said folded firebox.

18. An outdoor cooking unit as claimed in claim 17 and comprising a folded metal windbreak stored within said first cooking utensil and seated on said fire grate.

19. An outdoor cooking unit as claimed in claim 18 and comprising a handle stored in said first cooking utensil and disposed adjacent said folded firebox.

20. An outdoor cooking unit as claimed in claim 8 wherein said base has a bottom wall and comprising confronting legs hingedly attached to said base along the bottom wall of said base and retracted to engage the bottom wall of said base.

21. An outdoor cooking unit as claimed in claim 20 wherein each of said legs has a generally Z configuration in cross-sectional area.

22. An outdoor cooking unit in an extended state for a cooking mode comprising:

(a) a base plate;

(b) a firebox including a stove supported by said base plate; and (c) a windbreak disposed on said base plate underneath said firebox and surrounding said stove substantially in its entirety and in spaced relation to reduce heat loss during a cooking operation.

23. An outdoor cooking unit as claimed in claim 22 wherein said windbreak is foldable.

24. An outdoor cooking unit as claimed in claim 23 wherein said windbreak is formed from a metallic foil.

* * * * *